US009232840B2

(12) United States Patent
Lopatina

(10) Patent No.: US 9,232,840 B2
(45) Date of Patent: Jan. 12, 2016

(54) METHOD AND APPARATUS FOR CURLING HAIR

(71) Applicant: Elena Viktorovna Lopatina, Hong Kong (HK)

(72) Inventor: Elena Viktorovna Lopatina, Hong Kong (HK)

( * ) Notice: Subject to any disclaimer, the term of this patent is extended or adjusted under 35 U.S.C. 154(b) by 0 days.

(21) Appl. No.: 13/950,497

(22) Filed: Jul. 25, 2013

(65) Prior Publication Data

US 2015/0027485 A1 Jan. 29, 2015

(51) Int. Cl.

| | |
|---|---|
| ***A45D 6/14*** | (2006.01) |
| ***A45D 6/16*** | (2006.01) |
| ***A45D 2/12*** | (2006.01) |
| ***A45D 2/30*** | (2006.01) |
| *A45D 2/24* | (2006.01) |
| *A45D 2/14* | (2006.01) |

(52) U.S. Cl.

CPC *A45D 2/122* (2013.01); *A45D 2/30* (2013.01); *A45D 2/145* (2013.01); *A45D 2/148* (2013.01); *A45D 2/2478* (2013.01); *A45D 2/2485* (2013.01)

(58) Field of Classification Search

CPC ... A45D 2/2485; A45D 2/2478; A45D 2/148; A45D 2/145; A45D 2/2464; A45D 6/04; A45D 2/10; A45D 2/24; A45D 2/00; A45D 2/2421; A45D 2/122; A45D 2/2407

See application file for complete search history.

(56) References Cited

U.S. PATENT DOCUMENTS

| | | | | | |
|---|---|---|---|---|---|
| 1,376,358 | A * | 4/1921 | Popin | 132/221 | |
| 1,475,796 | A * | 11/1923 | Conine | 132/251 | |
| 1,490,293 | A * | 4/1924 | Scheib | 132/246 | |
| 2,630,127 | A * | 3/1953 | Isbell | 132/262 | |
| 2,651,309 | A * | 9/1953 | Kemp | 132/238 | |
| 2,905,186 | A * | 9/1959 | Pfalzgraf | 132/266 | |
| 3,016,909 | A * | 1/1962 | Schrock | 132/251 | |
| 3,073,318 | A * | 1/1963 | Catania | A45D 2/122 132/226 | |
| 3,439,686 | A * | 4/1969 | Klink | 132/251 | |
| 3,913,593 | A * | 10/1975 | Sato | 132/251 | |
| 4,216,787 | A * | 8/1980 | Moea | 132/250 | |
| 5,297,567 | A * | 3/1994 | Summerville et al. | 132/227 | |
| 5,474,096 | A * | 12/1995 | Dohmen | 132/252 | |
| 6,412,495 | B1 * | 7/2002 | Belman | A45D 6/14 132/210 | |
| 2004/0069316 | A1 * | 4/2004 | Kraus | 132/268 | |

FOREIGN PATENT DOCUMENTS

EP 890325 A1 * 1/1999

* cited by examiner

*Primary Examiner* — Robyn Doan

(74) *Attorney, Agent, or Firm* — Benman, Brown & William

(57) ABSTRACT

A hair curler comprising a cylindrical body having a longitudinal axis and a transverse axis and a removable rod extending through the body along the transverse axis thereof. The inventive curler enables a novel method of curling hair including the steps of curling the hair around the curler comprising a cylindrical body having a longitudinal axis and a transverse axis and a removable rod extending through the body along the transverse axis thereof and securing the curled hair to the head of a user by inserting a rod through the body of the curler along the longitudinal axis thereof. In the illustrative embodiment, the cylindrical body is perforated and has multiple protrusions. The cylindrical body has a variable diameter with tapered ends. The diameter of the body is smaller in the middle section thereof. The rod is beaded and has bends therein.

4 Claims, 6 Drawing Sheets

METHOD AND APPARATUS FOR CURLING HAIR

CROSS REFERENCE TO RELATED APPLICATION

This application claims priority from a provisional application entitled INVISIBLE HAIR ROLLER DEVICE/APPARATUS FOR CURLING HAIR AND METHOD OF USE, filed Aug. 9, 2012, Ser. No. 61/681,592 by Elena Lopatina.

BACKGROUND OF THE INVENTION

1. Field of the Invention

The present invention relates to personal grooming apparatus and methods. More specifically, the present invention relates to hair curlers.

2. Description of the Related Art

It is well-known to style hair by creating curls. One common method for curling hair involves the application of heat by way of a curling iron. Unfortunately, the high heat required to make the hair curl is deleterious to the hair. Hair rollers, also known as hair curlers, are commonly used as an alternative to heat to form semi-permanent curls in the hair of humans or animals. Typically hair rollers are formed as short cylindrical elements, such as metal or plastic rods or tubes, open-cell or closed-cell foam rods and the like. Rollers come in a variety of diameters for forming "tight" or "loose" curls depending on the particular style or fashion that a person desires or is in vogue at the time.

Curlers are typically used by rolling up the hair around the exterior periphery of the cylindrical curler and securing the curler to the hair with a frame, rubber band, Velcro fastener or other retaining solution. There are two problems with the use of conventional curlers.

First, existing arrangements to hold the hair in place on the curler often damaged the hair or otherwise created an unsightly crease therein. Such typical prior apparatus include a simple hair pin which has been used to physically pin hair to the roller along the longitudinal axis thereof.

Second, curlers are not attractive when in use and do not complement the looks of the user. Although the use of hair rollers is often carried out as part of an everyday private female toilette, it is uncommon for women to use rollers in the company of others. It is also uncommon to see women in public places with rollers in their hair. Some users view the use of hair rollers as a relatively embarrassing, albeit necessary task for maintaining an attractively curly hairdo.

Occasionally, however, a user may balk at the prospect of having to endure hair rollers in her hair for the first time or at any time. The reason for this is that hair rollers are visible implements and they typically do not make for a sight which users—mostly women—find flattering or attractive. Ordinarily, hair rollers are constructed as purely functional devices and none of the features of those devices promote or encourage the use of regular rollers outside of the privacy of the personal toilette where no-one or hardly anyone sees the regular rollers in use. Indeed, women do not want to be seen using regular rollers because they know this is an unflattering, unbecoming sight. Accordingly, conventional hair rollers are generally considered to be unsightly and unbecoming when in use, both by its users as well as by most people seeing them in use.

Hence, there is a need in the art for a hair roller that is not harmful to the hair and is constructed so as to promote and encourage the use of rollers in public, that is beyond the privacy of places and times of or for personal grooming, i.e. while socializing or present in public spaces outside private homes or in common rooms of a private home (or building) the use of which is shared with others. That is, there is a need for a safe, less unsightly and less unbecoming, and yet fully functional hair curler/roller solution.

SUMMARY OF THE INVENTION

The need in the art is addressed by the hair curler of the present invention. The inventive curler comprises a cylindrical body having a longitudinal axis and a transverse axis and a removable rod extending through the body along the transverse axis thereof.

In the illustrative embodiment, the cylindrical body is perforated and has multiple protrusions. The cylindrical body has a variable diameter with tapered ends. The diameter of the body is smaller in the middle section thereof. The rod is beaded and has bends therein.

The inventive curler enables a novel method of curling hair including the steps of curling the hair around the curler comprising a cylindrical body having a longitudinal axis and a transverse axis and a removable rod extending through said body along said transverse axis thereof and securing the curled hair to the head of a user by inserting a rod through the body of the curler along the transverse axis thereof.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

In view of the foregoing limitations and shortcomings of the prior art regular rollers, as well as other disadvantages not specifically mentioned above, it should be apparent that there still exists a need in the art of hair rollers which will appeal to women by virtue of their invisibility, as well as to effectively perform the function of curling the hair. There is also a continuing need in the art to expand the possibilities for construction of hair rollers to eliminate or at least very significantly reduce the embarrassment of wearing prior art regular rollers when these prior art regular rollers are visible to others.

The difference between the present invention and prior art regular rollers is that the invisible roller is completely covered by hair and thereby hidden from view, even from the sides.

Figure 1:
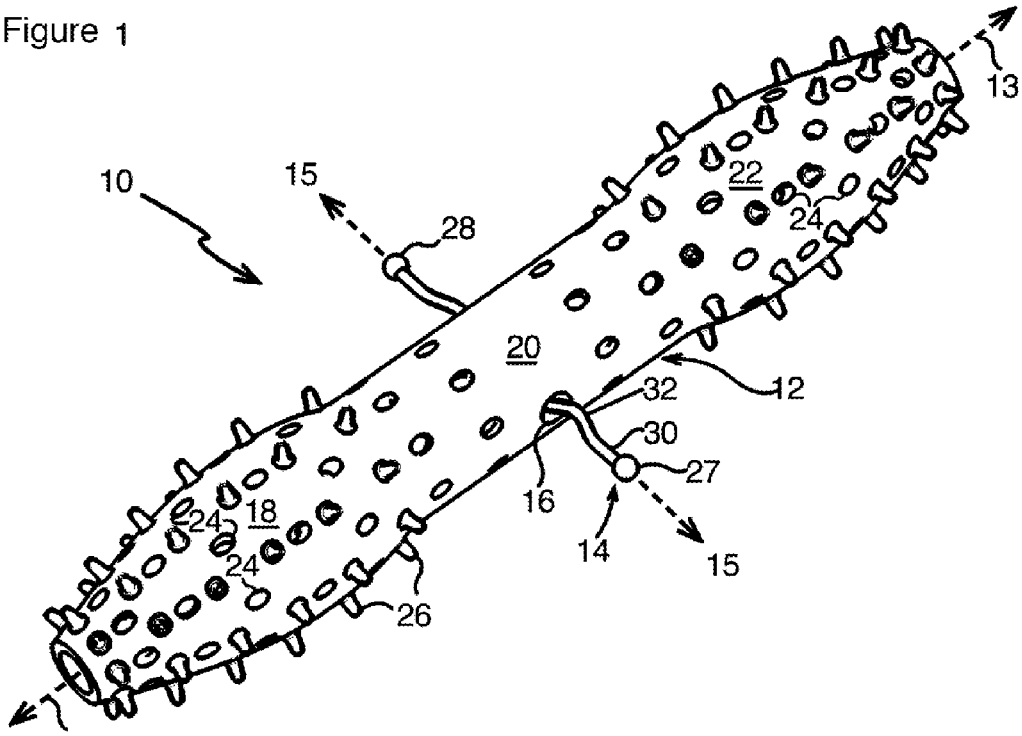
FIG. 1 is a front perspective view of an invisible hair curler implemented in accordance with an illustrative embodiment of the present invention.

FIG. 1 is a front perspective view of an invisible hair curler implemented in accordance with an illustrative embodiment of the present invention.

Figure 2:
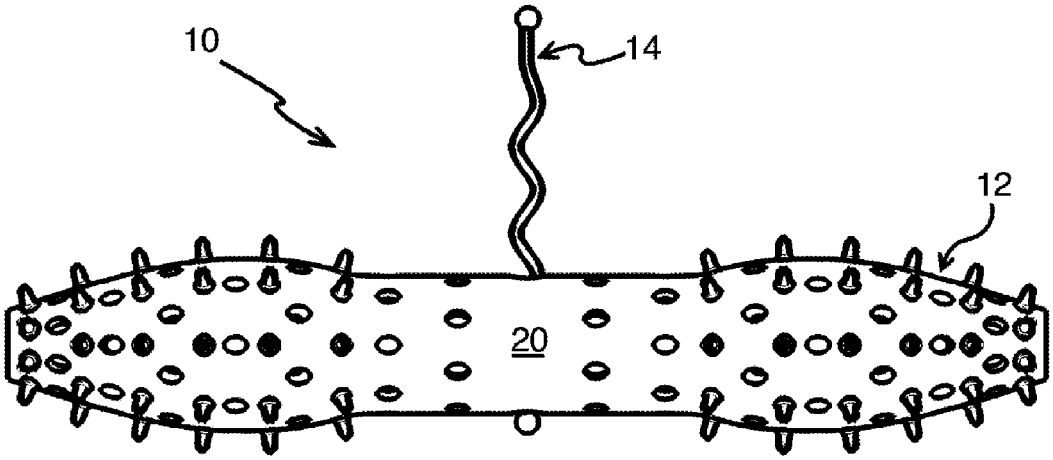
FIG. 2 is a front elevation view of the invisible hair curler of FIG. 1.

FIG. 2 is a front elevation view of the invisible hair curler of FIG. 1.

Figure 3:
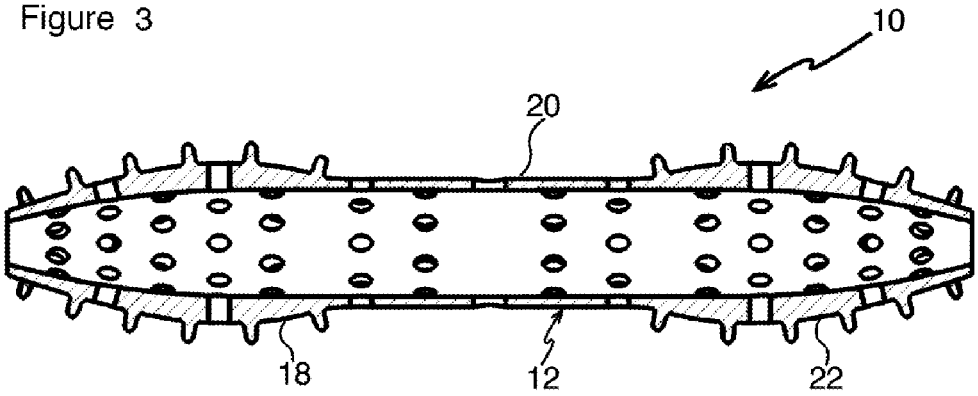
FIG. 3 is a sectional side view of the invisible hair curler of FIG. 1 along the longitudinal axis thereof with the holding rod removed.

FIG. 3 is a sectional side view of the invisible hair curler of FIG. 1 along the longitudinal axis thereof with the holding rod removed.

As shown in FIGS. 1-3, the inventive curler 10 is an assembly comprising an elongate generally cylindrical body portion 12 and one or more removable rods 14 extending therethrough when in use. The body has a longitudinal axis 13 and a transverse axis 15. In the illustrative embodiment, the roller body 12 is a hollow or solid cylinder with a proximal end 18, a mid section 20 and a distal end 22. In the best mode, the body is perforated with holes 24 to allow for airflow through the roller to create a lighter and more comfortable experience when in use as well as assist in the faster drying of wet hair as well as hair to which a curls-creating product was applied. The proximal and distal ends of the roller 12 are populated with optional protrusions or nubs 26, about 1 mm in height about the surface of the roller body 12 that serve to maintain the roller in place in the hair when in use.

The body 12 may be constructed of plastic, rubber, metal, wood or other suitable material. In the best mode, each curler 10 is approximately 5 cm to 10 cm in length and 1 cm to 3 cm in diameter. The rod 14 should be 4 cm to 6 cm in length and 1 mm to 2 mm in diameter.

The roller body 12 may be implemented in different lengths, shapes and sizes, including without limitation: straight, cylindrical, cigar, zeppelin shapes as well as wavy or curved shapes and/or combinations of these shapes. Different shapes help allow for a better match between length and type of hair, size or location of desired curl and optimize the winding and holding of hair.

Figure 4:
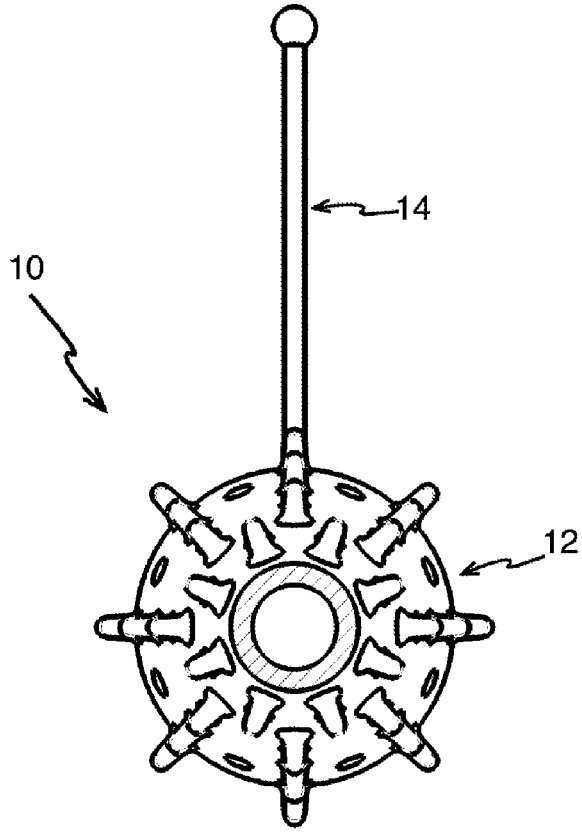
FIG. 4 is a sectional end view of the invisible hair curler of FIG. 1 along the transverse axis at the midsection thereof with the holding rod extended.

FIG. 4 is a sectional end view of the invisible hair curler of FIG. 1 along the transverse axis at the midsection thereof with the holding rod substantially removed.

Figure 5:
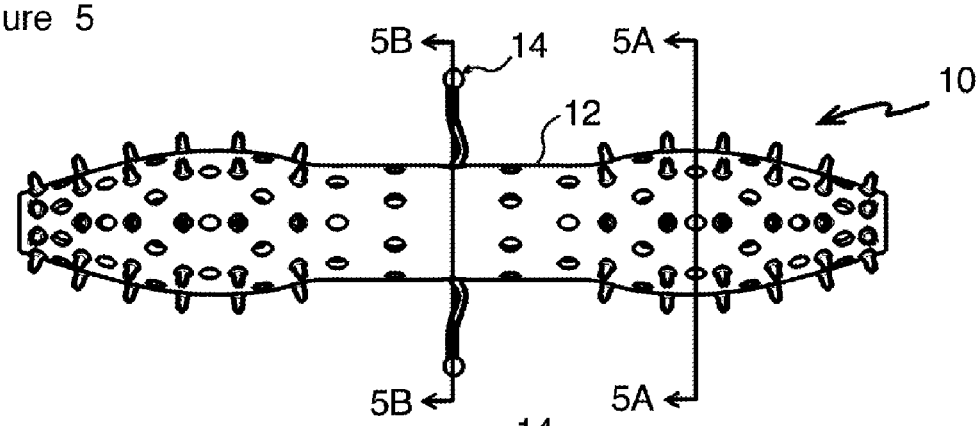
FIG. 5 is an elevated side view of the invisible hair curler of FIG. 1 with the holding rod in a middle position.

FIG. 5 is an elevated side view of the invisible hair curler of FIG. 1 with the holding rod in a middle position.

Figure 5A:
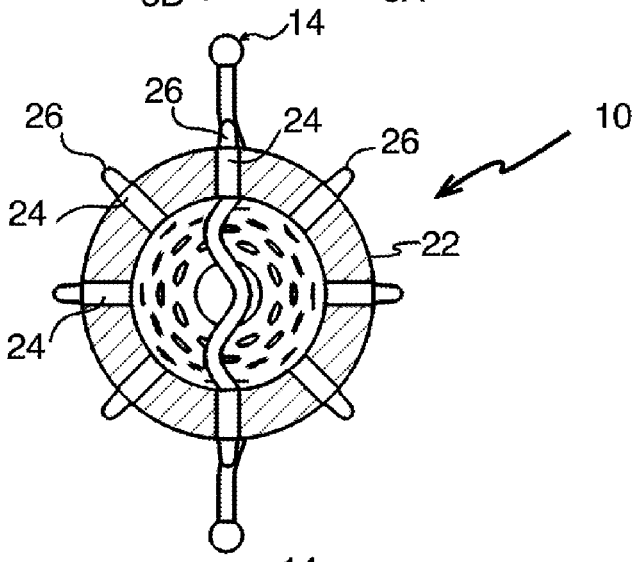
FIG. 5A is a sectional end view of the proximal end of the curler of FIG. 5.

FIG. 5A is a sectional end view of the proximal end of the curler of FIG. 5.

Figure 5B:
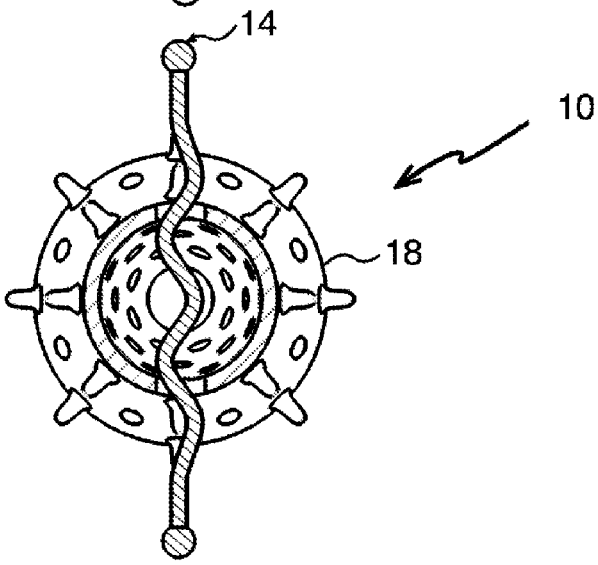
FIG. 5B is a sectional end view of the midsection of the curler of FIG. 5.

FIG. 5B is a sectional end view of the midsection of the curler of FIG. 5.

While FIGS. 4 and 5 illustrate a generally hollow body, those skilled in the art will appreciate that the roller body be hollow, solid, partially hollow or partially solid in the interior and can be made of any material, including without limitation: rubber, plastic, foam, metal, and combinations of these materials without limitation. Other cylindrical materials may be used as well such as coils or webs without departing from the scope of the present teachings.

As shown in FIGS. 1-5, the rod 14 extends through apertures 16 the mid-section of the roller body 12. However, the apertures may be located elsewhere on the body, including the distal and proximal ends thereof, to allow for the rod to pass therethrough in multiple directions and angles to retain the roller in place as discussed more fully below.

For safety, the rod 14 has first and second beads 27 and 28 that cap opposite ends of a shaft 30 thereof. Note that in the illustrative embodiment, the shaft 30 has a number of bends 32 that serve to inhibit slippage of the rod 14 out of position when in use. However, the shaft 30 may be straight without departing from the scope of the present teachings.

The rod 14 can be made of any materials, including without limitation: plastics, metals and combinations of these materials as well as any new materials as may become available and which are suitable for expressing this part of present invention and design. The rod 14 may be straight, wavy, ridged or curved with or without the small rounded beads 27 and 28 at the ends thereof. The length and diameter of the rod(s) depends on roller body material or materials and can vary. In any case, the rod should be sufficiently strong to hold the hair in place without breaking. One or multiple rods 14 can be used and the rods can be located in the center, off-center (to facilitate inclusion of the hair ends at the start of rolling) and at both ends of the roller body.

The novel operation of the present invention is illustrated in FIGS. 6-9 below. After combing as necessary, the curler 10 is placed against the strands of hair near the distal end (most distant from the head) thereof. The hair 40 is then rolled around the curler 10 as depicted in FIGS. 6A-6C. The rod 14 easily passes through the hair during the winding. Because, in the best mode, the rod 14 is already installed in the curler, all a user needs to do—after completing the winding—is to push it in further to (firmly) lock the roller in place.

Figure 6A:
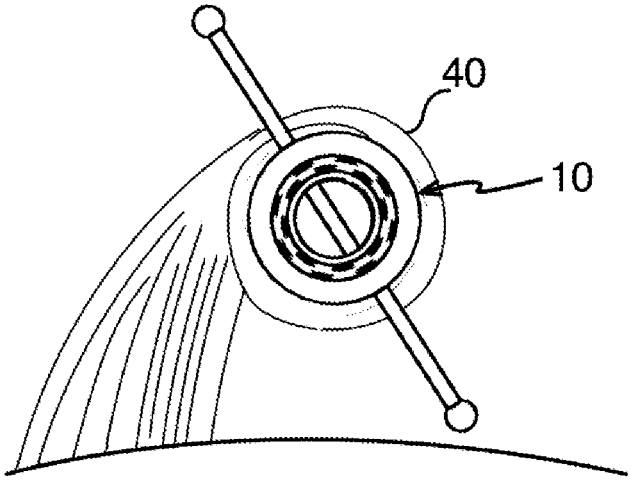
FIG. 6A is a side view of the invisible hair curler of FIG. 6 in an early stage engagement with the hair of a user with the holding rod inserted (under 90 degrees to the body of the roller).
Figure 6B:
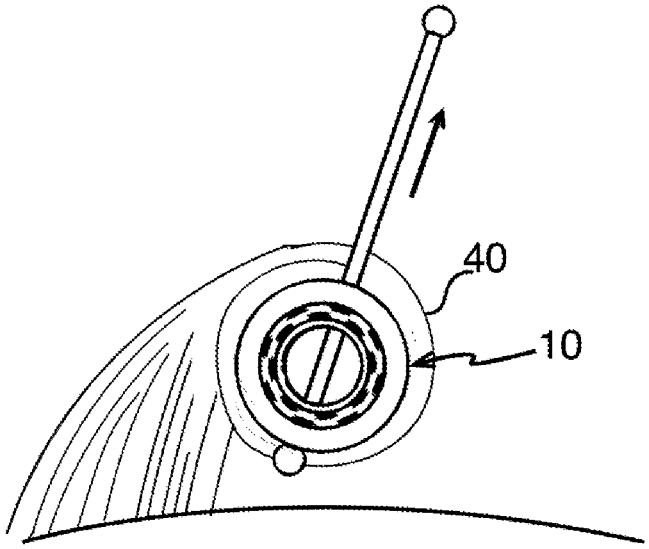
FIG. 6B is a side view of the invisible hair curler of FIG. 7A rotated such that the user's hair partially wrapped around the body of the curler with the holding rod inserted (under 90 degrees to the body of the roller) and extended out to allow passage of the lower end of the holding rod in the final position.
Figure 6C:
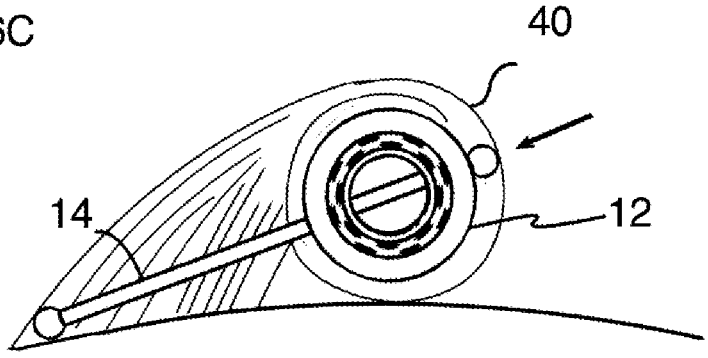
FIG. 6C is a side view of the invisible hair curler of FIG. 7A further rotated such that the user's hair fully wrapped around the body of the curler and the holding rod in the locking position.
Figure 7:
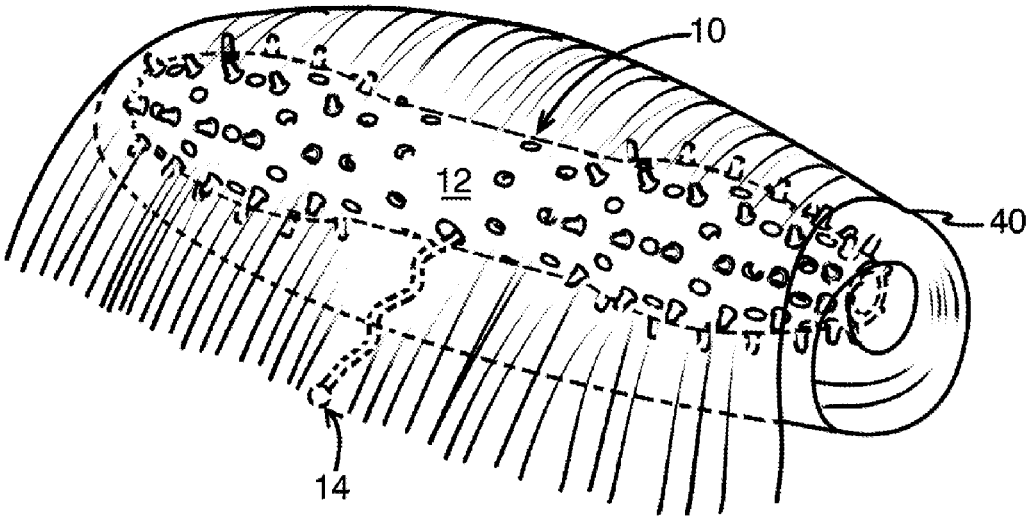
FIG. 7 shows a perspective view of the invisible hair curler of FIG. 1 in operation.

FIG. 6A is a side view of the invisible hair curler of FIG. 6 in an early stage of engagement with the hair of a user. FIG. 6B is a side view of the invisible hair curler of FIG. 6A rotated such that the user's hair 40 is partially wrapped around the body of the curler 12. FIG. 6C is a side view of the invisible hair curler of FIG. 6A further rotated such that the user's hair is fully wrapped around the body of the curler. When the hair 40 is fully wrapped around the curler 10, the rod 14 is pushed through further as shown in FIG. 6C. As shown in FIG. 6C, the rod 14 limits rotation of the curler 12 in the counter-clockwise direction and thereby retains the curler in place as well as the curled state of the hair 40. The rods are moved from the central position to the left or to the right side of a roller to lock the hair in place preventing the hair from unrolling. The user simply pushes the side of the rod which is sticking out of the hair in the general direction of the head of the person whose hair is being curled, to lock the roller in place. These removable holding rod(s) assist in hiding the hair roller from view completely. The holding rods firmly hold and keep each roller in place, preventing hair locks from unrolling. Unlocking is enabled by means of removing the rods from the body. FIG. 7 shows a perspective view of the invisible hair curler of FIG. 1 installed in one's hair 40.

As noted above, in the best mode, the rods are installed in the roller body prior and during winding. Those skilled in the art will appreciate that in the alternative methodological embodiment, the hair may be wrapped in the roller without the rod installed until it is fully curled and ready to be secured without departing from the scope of the present teachings.

Typically, during winding, both ends of the rods stick out of the body outside the central roller as shown in FIG. 6A.

Figure 8:
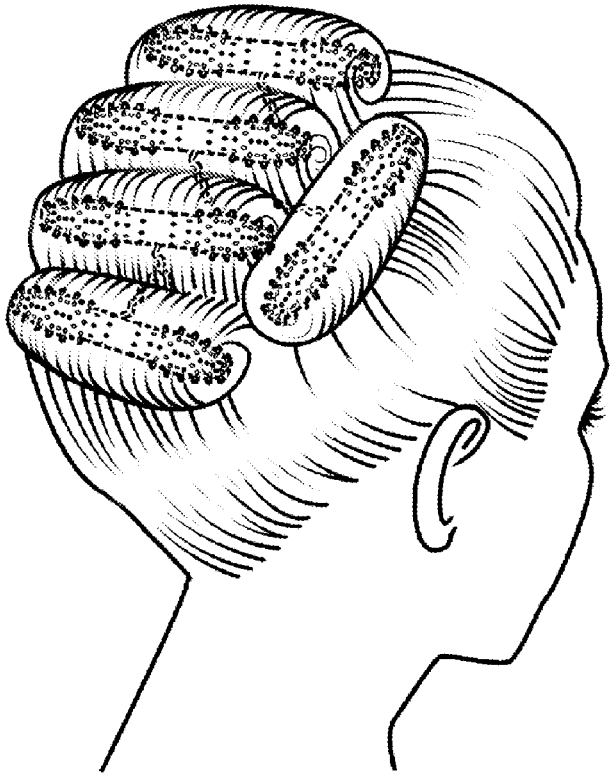
FIG. 8 is a rear perspective view of the head of a user of a number of invisible hair curlers, shown in phantom, in accordance with the present teachings.

FIG. 8 is a rear perspective view of the head of a user of a number of invisible hair curlers, shown in phantom, in accordance with the present teachings.

Figure 9:
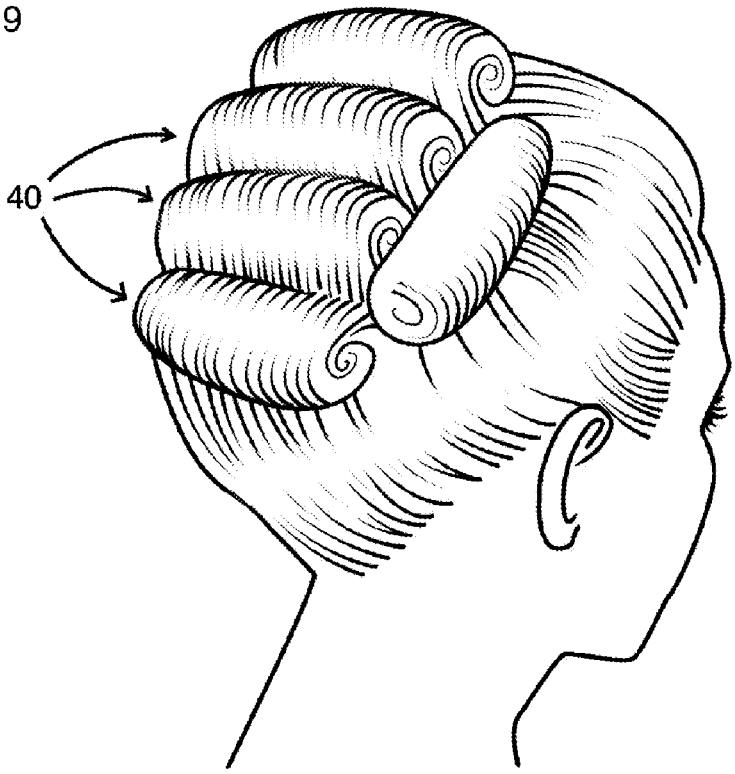
FIG. 9 is a rear perspective view of the head of a user of a number of invisible hair curlers in accordance with the present teachings.

FIG. 9 is a rear perspective view of the head of a user of a number of invisible hair curlers in accordance with the present teachings.

Figure 10:
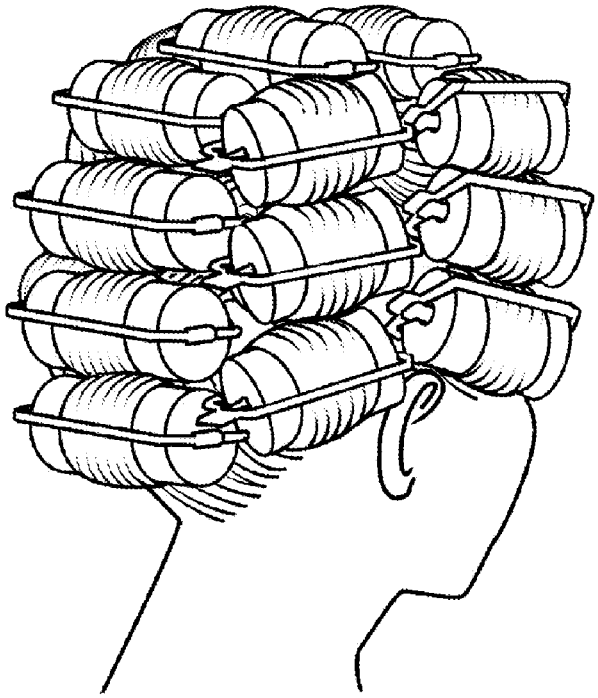
Figure 10 PRIOR ART
FIG. 10 is a rear perspective view of the head of a user of a number of conventional hair curlers in accordance with the prior art.

FIG. 10 is a rear perspective view of the head of a user of a number of conventional hair curlers in accordance with the prior art.

FIGS. 8 and 9 illustrate that when the curlers 10 are installed as shown in FIG. 8, they are not visible as depicted in FIG. 9. The resulting appearance of the user's head using the inventive curlers as depicted in FIG. 9 will be seen as being more attractive—i.e. less unsightly and less unbecoming—than that of a user of conventional curlers as depicted in FIG. 10. Moreover, a particularly advantageous aspect of the invention is that the curls may be secured permanently without the deleterious application of heat or other means that might be damaging to the hair.

The curlers 10 can be transparent or have a color close to the hair color itself. The invisible hair rollers of the present invention should be fabricated of a material that will not deteriorate or deform under high temperature operating conditions.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. A hair curler consisting of:

a cylindrical perforated body having two ends and an intermediate portion therebetween, said intermediate portion having a uniform diameter and said ends being tapered and having multiple protrusions, said cylindrical body having a longitudinal axis, a transverse axis, and a variable diameter such that said body is smaller in the intermediate portion with respect to adjacent ends thereof and one or more removable rods extending through the intermediate portion of said body along said transverse axis thereof, whereby said rod, when installed, said rod engages the head of the user on one end thereof and thereby secures the curler against counter-rotational motion until removed and said hair curler is substantially obscured by the hair of the user when installed.

2. The invention of claim 1 wherein said rod has beads on the ends thereof.

3. The invention of claim 1 wherein said rod has bends.

4. A method for curling hair including the steps of:

curling hair in a first direction of rotation in a curler consisting of:

a cylindrical perforated body having two ends and an intermediate portion there between, said intermediate portion having a uniform diameter and said ends being tapered and having multiple protrusions, said cylindrical body having a longitudinal axis, a transverse axis, and a variable diameter such that said body is smaller in the intermediate portion with respect to adjacent ends thereof and at least one removable rod extending through said body along said transverse axis thereof and securing said curled hair to the head of a user by inserting said rod through the body of said curler along the transverse axis thereof, whereby said rod, when installed, engages the head of the user on one end thereof and thereby secures the curler against counter-rotational motion in a second direction until removed and said hair curler is substantially obscured by the hair of the user when installed.

* * * * *